US008870192B2

(12) United States Patent
Othman

(10) Patent No.: US 8,870,192 B2
(45) Date of Patent: Oct. 28, 2014

(54) WHEELED PERSONAL TRANSPORTATION DEVICE POWERED BY WEIGHT OF THE USER

(71) Applicant: Umm Al-Qura University, Makkah (SA)

(72) Inventor: Fadel M. Y. Othman, Makkah (SA)

(73) Assignee: Umm Al-Qura University, Makkah (SA)

( * ) Notice: Subject to any disclaimer, the term of this patent is extended or adjusted under 35 U.S.C. 154(b) by 0 days.

(21) Appl. No.: 13/735,988

(22) Filed: Jan. 7, 2013

(65) Prior Publication Data

US 2013/0119622 A1 May 16, 2013

Related U.S. Application Data

(63) Continuation-in-part of application No. 12/253,260, filed on Oct. 17, 2008, now abandoned.

(60) Provisional application No. 60/981,512, filed on Oct. 21, 2007.

(51) Int. Cl.
*A63C 17/12* (2006.01)
*A63C 17/06* (2006.01)

(52) U.S. Cl.
CPC *A63C 17/12* (2013.01); *A63C 17/06* (2013.01)
USPC ..... 280/11.115

(58) Field of Classification Search
CPC ..... A63C 17/12
USPC ..... 280/11.115
See application file for complete search history.

(56) References Cited

U.S. PATENT DOCUMENTS

| | | | | | |
|---|---|---|---|---|---|
| 999,660 | A | * | 8/1911 | Koppel | 280/11.115 |
| 1,208,173 | A | * | 12/1916 | Lenhardt | 280/11.115 |
| 1,628,004 | A | | 5/1927 | Stetson | |
| 1,924,948 | A | * | 8/1933 | Lieberenz | 280/11.115 |
| 2,174,990 | A | * | 10/1939 | Maguire | 280/11.115 |
| 2,449,871 | A | * | 9/1948 | Bohler | 280/11.115 |
| 2,536,569 | A | * | 1/1951 | Purkey | 280/11.115 |
| 2,755,596 | A | * | 7/1956 | Hermann | 446/37 |
| 3,980,152 | A | * | 9/1976 | Manor | 180/313 |

(Continued)

FOREIGN PATENT DOCUMENTS

| | | | |
|---|---|---|---|
| DE | 10050175 | A1 * | 4/2002 |
| FR | 2839443 | A1 * | 11/2003 |

*Primary Examiner* — Joseph M Rocca
*Assistant Examiner* — Daniel Yeagley
(74) *Attorney, Agent, or Firm* — Richard C. Litman

(57) ABSTRACT

The wheeled personal transportation device includes a frame member having opposed front and rear ends having front and rear wheels rotatably mounted thereto. An air cushion has upper and lower ends, the lower end being supported by the frame member. A foot platform is mounted on the upper end of the air cushion, the foot platform being adapted for supporting a foot of a user. A pneumatic motor is mounted on the front end of the frame member and is in communication with the front wheel for selectively driving rotation thereof. The pneumatic motor is in fluid communication with the air cushion such that compression of the air cushion by the user's foot drives the pneumatic motor to drive rotation of the front wheel. A pneumatic brake is further in communication with the rear wheel for selective braking thereof. Alternatively, the front wheel may be powered mechanically by spring-biased gears.

13 Claims, 12 Drawing Sheets

(56) References Cited

U.S. PATENT DOCUMENTS

| | | | | | |
|---|---|---|---|---|---|
| 4,072,317 | A | | 2/1978 | Pommerening | |
| 4,087,105 | A | | 5/1978 | Amarantos | |
| 4,370,857 | A | * | 2/1983 | Miller | 60/413 |
| 4,451,055 | A | * | 5/1984 | Lee | 280/221 |
| 4,546,990 | A | | 10/1985 | Harriger | |
| 4,706,974 | A | * | 11/1987 | Vincent | 280/11.115 |
| 4,896,753 | A | | 1/1990 | Sule | |
| 5,232,231 | A | * | 8/1993 | Carlsmith | 280/11.215 |
| 5,492,345 | A | | 2/1996 | Kruczek | |
| 5,538,270 | A | | 7/1996 | Gajek et al. | |
| 5,609,346 | A | * | 3/1997 | Bellehumeur | 280/11.204 |
| 5,647,724 | A | * | 7/1997 | Davis et al. | 414/744.5 |
| 5,704,617 | A | | 1/1998 | Stoughton et al. | |
| 5,931,480 | A | | 8/1999 | Schroeder | |
| 6,065,763 | A | | 5/2000 | Adams, Jr. | |
| 6,237,923 | B1 | * | 5/2001 | Fowle | 280/11.115 |
| 6,315,313 | B1 | * | 11/2001 | Huang | 280/216 |
| 6,446,982 | B1 | | 9/2002 | Gaster et al. | |
| 6,585,273 | B2 | | 7/2003 | Chiu | |
| 6,592,129 | B1 | | 7/2003 | Gates | |
| 6,871,860 | B1 | | 3/2005 | Esse ya | |
| 7,073,805 | B2 | | 7/2006 | Yan | |
| 7,216,876 | B2 | | 5/2007 | Cole et al. | |
| 7,866,672 | B2 | * | 1/2011 | Brunner | 280/11.115 |
| 7,950,166 | B1 | | 5/2011 | Perenich | |
| 2002/0084601 | A1 | | 7/2002 | Wu | |
| 2003/0047893 | A1 | * | 3/2003 | Pahis | 280/11.115 |
| 2004/0237178 | A1 | | 12/2004 | Landeros | |
| 2005/0236801 | A1 | | 10/2005 | Tal | |
| 2006/0255554 | A1 | * | 11/2006 | Cole | 280/87.042 |
| 2011/0092339 | A1 | * | 4/2011 | Stewart | 482/52 |

* cited by examiner

WHEELED PERSONAL TRANSPORTATION DEVICE POWERED BY WEIGHT OF THE USER

CROSS-REFERENCE TO RELATED APPLICATION

This application is a continuation-in-part of U.S. patent application Ser. No. 12/253,260, filed Oct. 17, 2008, which claimed the benefit of U.S. Provisional Patent Application Ser. No. 60/981,512, filed Oct. 21, 2007.

BACKGROUND OF THE INVENTION

1. Field of the Invention

The present invention relates to personal transportation, and particularly to a wheeled personal transportation device powered by weight of the user in the form of an in-line skate.

2. Description of the Related Art

Transportation is a necessity of modern life. Most activities require personal movement from one place to another for work, pleasure or the like. Most transportation devices have their own limitations and drawbacks with regard to health and the environment. Therefore, an efficient, cost effective, healthy, and environmentally friendly personal transportation system is needed.

Vehicles may be relatively fast and comfortable. However, they are costly, not friendly to the environment, and are inefficient on congested roadways. Moreover, vehicles are responsible for limiting exercise of the users, thus encouraging unhealthy sedentary lifestyles.

Walking is healthy and environmentally friendly, but it is limited to short distance trips. Walking long distances may not be suitable for many people, since it takes much effort and time, especially for daily trips. In-line skates are compact and can be used as personal transportation devices. However, the oscillating movement of the body required to push skates forward is inefficient and consumes much power over long distances. Skates are, therefore, more suitable for sport than for daily movements.

Electrically powered skates can be used as personal transportation devices. However, the need to recharge them limits their range, the use of batteries increases their cost, and their use does not encourage people to move. Bicycles are efficient as a means of transportation for short to medium distances. They are relatively fast, healthy and environmentally friendly. However, they are quite bulky and cannot be easily integrated with public transportation. For example, if the trip is relatively long, one may ride his or her bicycle to the nearest bus or train station, but they must park it somewhere in order to be able to use public transportation. Moreover, if the rider's destination is not near a station, then he or she must walk a long distance or use other means of transportation.

Therefore, there is a need for a personal transportation device that can cover short to medium distances, and which can be easily integrated with other modes of transportation. It would be further desirable to provide such a personal transportation device that is compact, has a low cost, is healthy to use, and is environmentally friendly.

Thus, a wheeled personal transportation device powered by the weight of the user solving the aforementioned problems is desired.

SUMMARY OF THE INVENTION

The wheeled personal transportation device powered by weight of the user relates to personal transportation, and particularly to an in-line skate that is powered by the user's weight. The wheeled personal transportation device includes a frame member having opposed front and rear ends, a front wheel rotatably mounted to the front end, and a rear wheel rotatably mounted to the rear end. The device has an air cushion (or bellows-type air pump) having upper and lower ends, the lower end being supported by the frame member. A foot platform is mounted on the upper end of the air cushion. The foot platform is adapted for supporting a foot of a user.

A pneumatic motor is mounted on the front end of the frame member. The front wheels are mounted on the shaft of the pneumatic motor. The pneumatic motor is in fluid communication with the air cushion. Compression of the air cushion by the user's foot drives the pneumatic motor, which drives rotation of the front wheel. A pneumatic brake is in communication with the rear wheel for selective braking thereof.

In an alternative embodiment, the front wheels are driven mechanically. The foot platform is connected to the inline wheel frame member by a pair of scissor arms. The rear of the scissor arms are pivotally attached to the foot platform and the frame member, respectively, while the front of the scissor arms are both pivotally and slidably attached to the foot platform and the frame member. The user raises the boots up and down, and sliding movement of one of the scissor arms pulls a crank member, causing a gear to rotate and compress a torsion spring connected to the gear by a one-way clutch. The torsion spring acts like a mainspring, and expansion of the torsion spring rotates an axle, on which the drive wheel of a chain and sprocket mechanism is mounted. The driven wheel of the chain and sprocket mechanism is coaxial with a bevel gear or the like, which engages a gear on the axle of the front wheel of the inline skate, thereby driving the front wheel.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
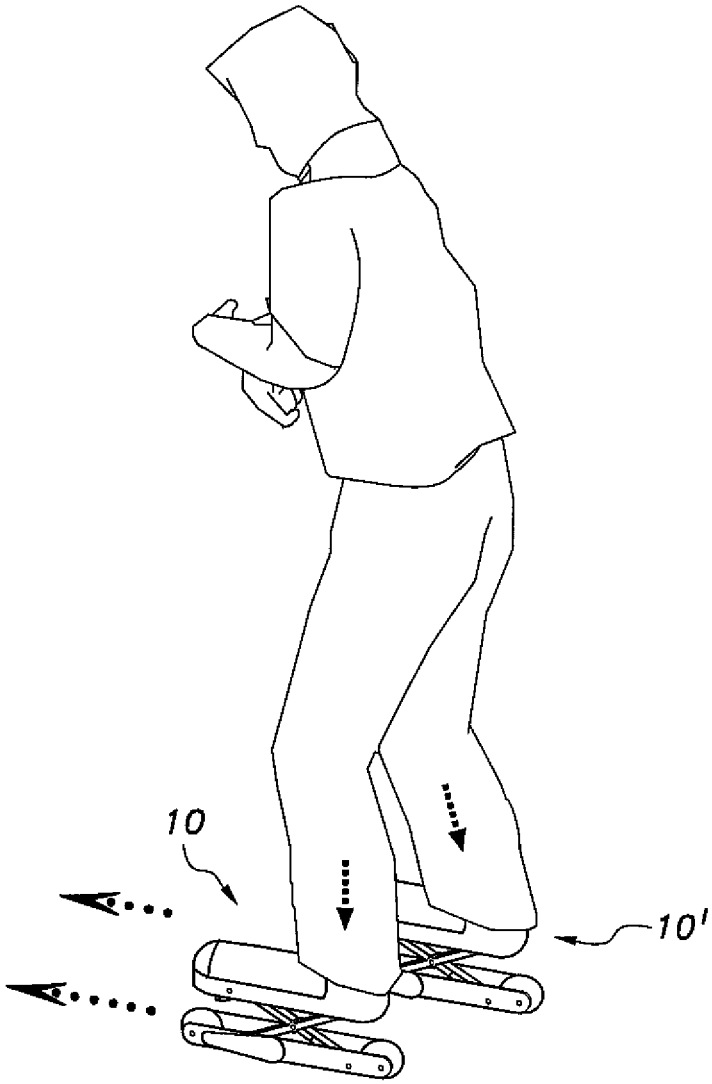
FIG. 1 is an environmental perspective view of a first embodiment of a wheeled personal transportation device powered by the weight of the user according to the present invention.

Referring to FIG. 1, a user is shown standing atop a pair of personal transportation devices 10, 10'. The first device 10 supports the left foot, while the second device 10' supports the right foot of the user. Both devices are almost identical and work in the same way, independently of each other. The following description will focus on device 10, bearing in mind that similar description applies to device 10'. More detailed illustrations of the device 10 are presented in FIGS. 2-5.

Figure 2:
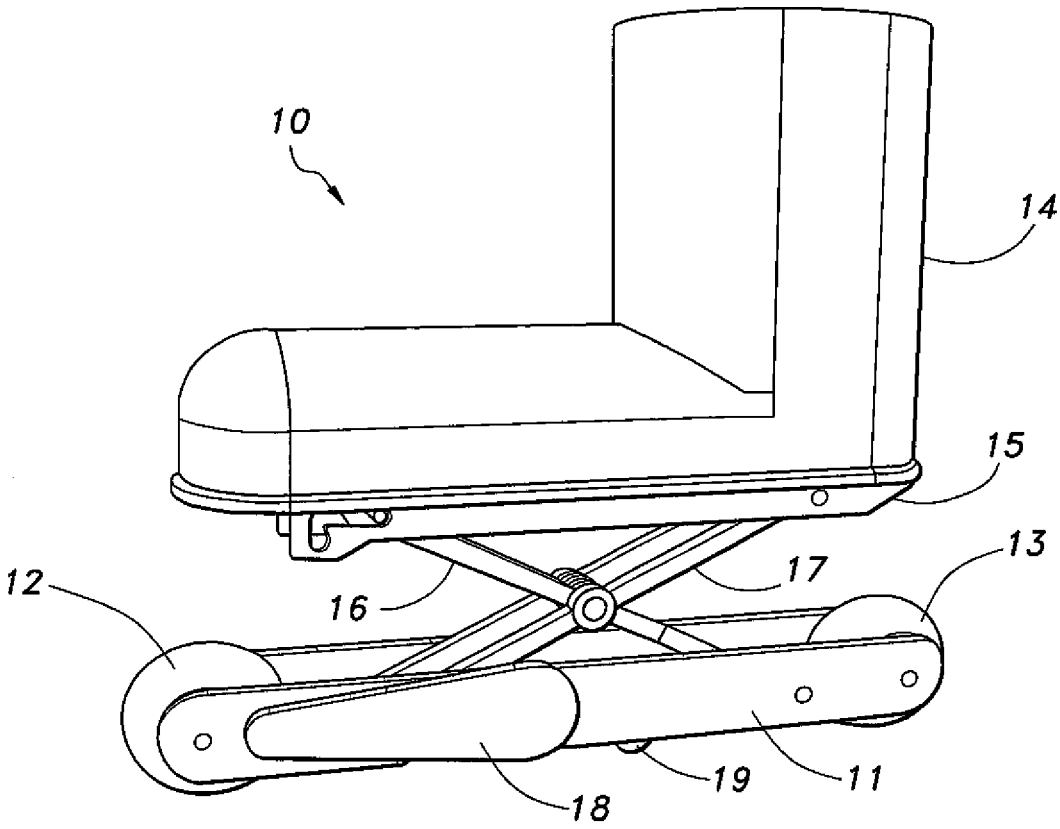
FIG. 2 is a perspective view of the wheeled personal transportation device of FIG. 1, shown with the boot raised.

The transportation device 10, as shown in FIG. 2, includes foot platform 15 attached securely to a specially designed boot or hard shoe 14 to support and to protect the user's foot. The foot platform 15 is connected to the transportation attachment 11 of inline wheels by linkage mechanisms 16 and 17, which include a first pair of parallel scissor arms 16 and a second pair of parallel scissor arms 17, which are joined at their center by a pivot pin The rear ends of scissor arms 16 are pivotally attached to a pin 50 fixed in the frame member of the transportation attachment 11, and the rear ends of scissor arms 17 are pivotally attached to a pin 52 fixed in the foot platform 15, so that the rear ends of the scissor arms 16 and 17 are free to pivot, but cannot slide forward and rearward. The front ends of the scissor arms 16 are pivotally attached to a pivot pin 16' that is slidable in parallel slots 54 defined in the front end of the foot platform 15, and the front ends of the scissor arms 17 are pivotally attached to a pivot pin 17' that is slidable in parallel slots 60 defined in the frame member of the transportation attachment 11. Thus, the front ends of the scissor arms 16 and 17 are free to both pivot and to slidably translate forward and rearward. The foot platform 15 is located above the transportation attachment 11 in relation to the support surface, and it supports the user's foot so that the longitudinal axis of the user's foot can be positioned in the direction of the intended motive direction supplied by the transportation attachment 11.

Figure 3:
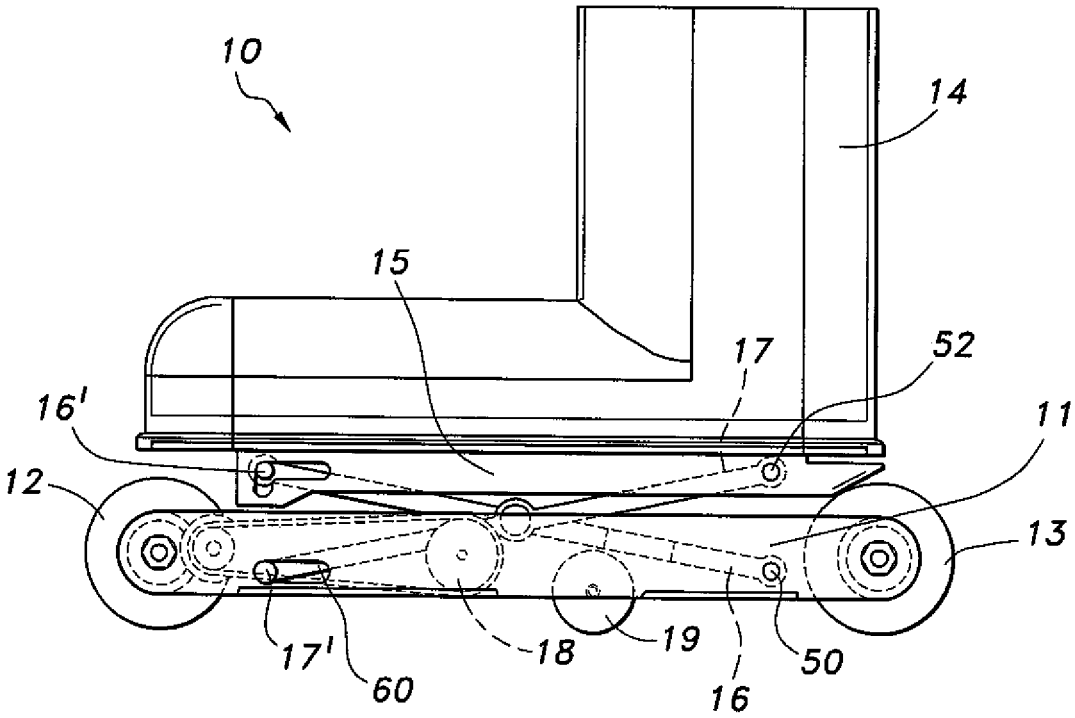
FIG. 3 is a side view of the wheeled personal transportation device of FIG. 2, shown with the boot lowered.
Figure 4:
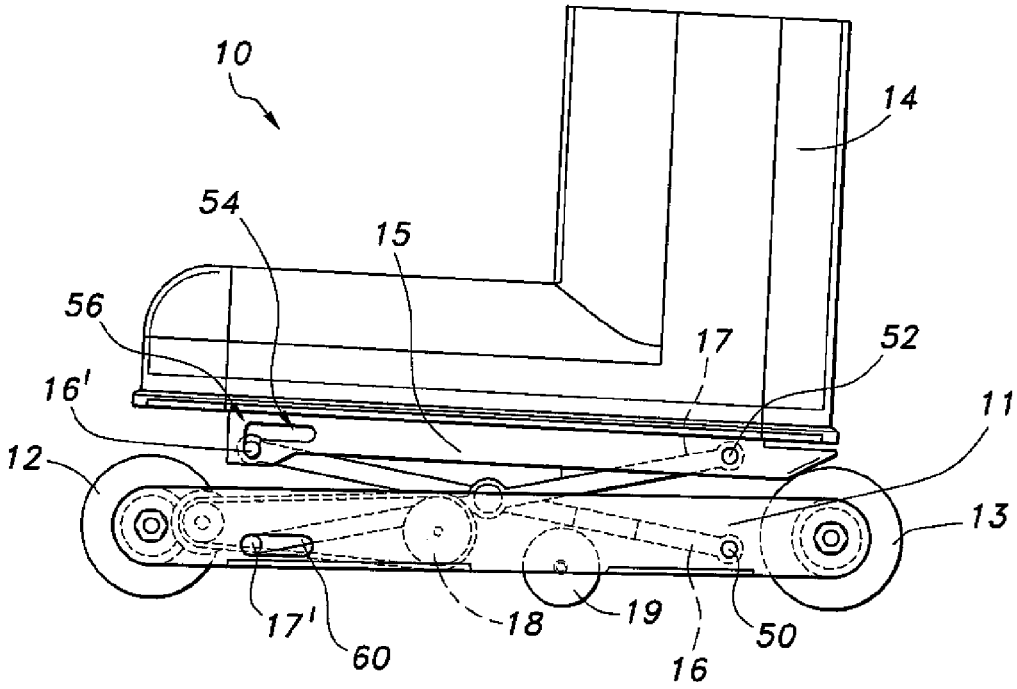
FIG. 4 is a side view of the wheeled personal transportation device of FIG. 3, shown in a braking configuration.

FIG. 2 shows the transportation device 10 with the foot platform 15 in a high position at the beginning of a pressing stage. FIG. 3 shows the transportation device 10 with foot platform 15 in a low position at the end of the pressing stage, and also in the configuration used during normal cruising. FIG. 4 shows the transportation device during a braking stage, which is actuated by the user's foot tilting the foot platform 15 backward.

The transportation attachment 11 includes inline ground-engaging wheels 12, 13 and 19, which rotate about their axles to allow the transportation attachment 11 to move forward. As shown, wheel 12 is positioned in front (with respect to the orientation of the user's foot; i.e., nearest the user's toes), wheel 13 is positioned in the rear, and wheel 19 is positioned centrally and between wheels 12, 13. The frame of the transportation attachment 11 supports most of the components of the transportation device 10.

Returning to FIG. 2, the foot platform 15 holds the weight of the user and transfers it to the linkage 17. Linkage 16 is used to keep the platform 15 in a parallel position with respect to transportation attachment 11. The two linkages are interconnected in the middle by a common axle, with an X-shape or scissors configuration. As best seen in FIGS. 3 and 4, the two linkages 16, 17 are free to rotate about their rear axles 50, 52, respectively, and slide forward while rotating about their front axles 16' and 17', respectively, thus allowing the foot platform 15 to move from the high to the low position. Linkage 17 is connected through axle 17' to the driving mechanism 18.

FIG. 4 shows the transportation device 10 in the braking stage. It should be understood that braking may be performed by any conventional braking system. In the preferred embodiment, the user simply tilts his or her feet and body slightly backward to actuate braking. A bend 56 formed in the front end of a sliding groove 54 in which the front axle 16' is mounted allows the foot platform 15 to tilt about the rear axle 52 of linkage 17. This tilting action causes the braking pad 20 (shown in the embodiment of FIG. 8) to come into direct contact with the rear wheel 13. The more the rider tilts the foot platform 15, the stronger the braking effect, as the pressure between the braking pad 20, which is mounted on the rear of the platform 15, is increased. Further, one of the wheels can also be activated to engage the gear assembly for slowing down. The gear assembly, shown in FIG. 5, includes gear 22, driving gear 24, gear set 26 and axle assembly 27.

The braking of the rear wheel 13 provides stability to the transportation device 10, since the rear wheel 13 will pull the device 10 backward; i.e., opposite to the direction of movement. Tilting the foot platform 15 and the user's body backward provides additional stability during braking, since the body of the rider still has forward momentum. Moreover, the low position of the foot platform 15 during braking provides further stability by lowering the center of mass of the overall device 10.

The driving mechanism 18 converts the forward linear movement of the front axle 17', forced by the weight of the rider, to forward rotational movement of the front wheel 12. The rider repeats moving his or her feet up and down in an oscillating pedaling-type or walking-type motion to accelerate or to maintain speed. The greater the frequency of the user's up-down foot motion, the greater the user accelerates. The front wheel 12 is used to drive the transportation device to provide more stability to the rider during acceleration due to its pulling effect in the direction of movement.

Figure 5:
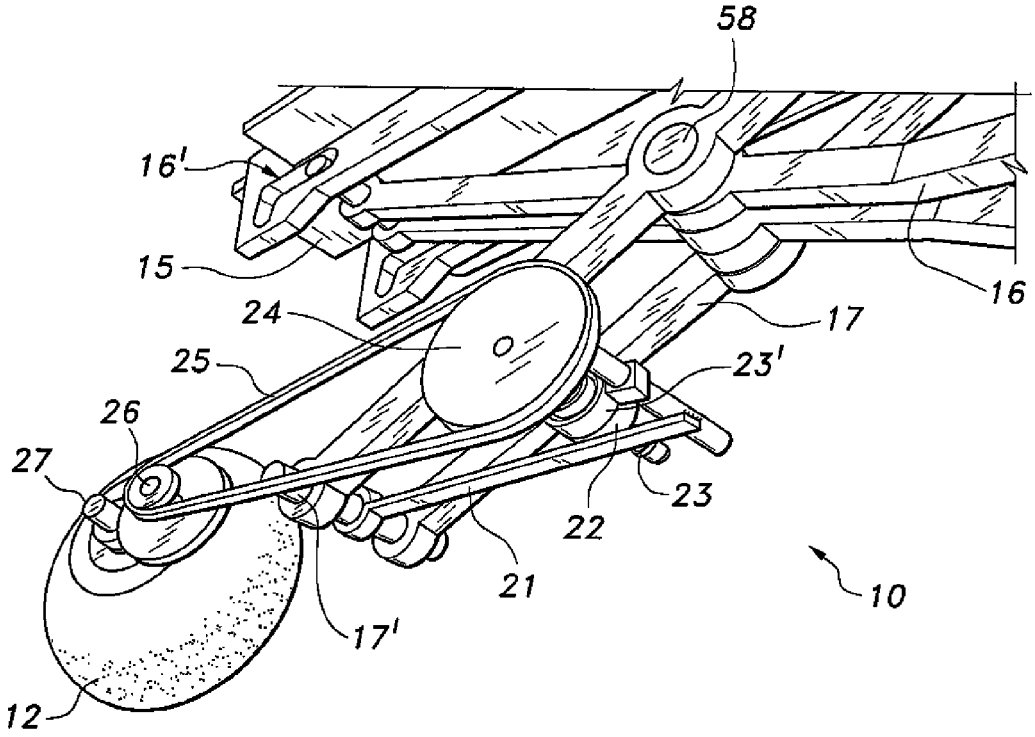
FIG. 5 is a partial perspective view the wheeled personal transportation device of FIG. 2, shown with the frame removed in order to show the mechanical drive mechanism.

FIG. 5 shows the driving mechanism 18 in detail. The driving mechanism 18 stores, amplifies, and converts the linear movement of the front axle 17' to revolution of the front wheel 12. The central pivot of the X-type configuration of the linkage mechanisms 16, 17 is designated generally as 58 in FIG. 5. As the user pushes his or her foot down, lowering the foot platform 15, the scissor arms 17 rotate about pivot 58 and pivot pin 52. As the front axle or pivot pin 17' is forced by the weight of the rider to slidably move forward within slots or grooves 60 (as best shown in FIGS. 3 and 4) in the frame of the transportation attachment 11, it pulls sliding linkage or crank member 21, causing the gear 22 to rotate. The gear 22 is connected to a spring and axle assembly 23. The spring and axle assembly 23 performs two tasks. First, it stores the rotational force as spring potential energy by twisting the spring (a torsion spring), compressing the torsion spring portion of the assembly 23, which is connected to the gear 22 by a one-way clutch 23'. Second, the torsion spring acts like a mainspring, and expansion of the torsion spring rotates the axle portion of the assembly 23, on which the drive wheel 24 of a chain and sprocket mechanism 25 is mounted. The driven wheel or gear set 26 of the chain and sprocket mechanism is coaxial with a bevel gear or the like, which engages a gear on the axle 27 of the front wheel 12 of the inline skate, thereby driving the front wheel 12. As an alternative, an auto-shift gear set can be added to the driving mechanism 18 instead of the gear set 26 for long-distance and high-speed versions of the transportation device 10.

One-way clutches are used internally in the gear 22 and in the axle and gear assembly 27 to force rotation to be in one direction while pressing, and to allow free backward rotation in another direction. Introducing the spring and axle assembly 23 into the driving mechanism 18 allows the foot platform 15 to move from the higher to the lower position instantly for better stability, while also storing the downward force in the spring to drive the device 10 continuously and smoothly.

One-way clutches can also be used in wheels 12, 13 and 19 to allow the transportation device to move only in the forward direction. This will aid the rider in climbing steep ramps by pushing one of the transportation devices 10, 10' forward while being supported by the other one, and so on.

It should be understood that the foot platform 15 may be of different shapes and configurations. Preferably, a hard and hinged shoe or boot 14 is used to support and to protect the foot of the rider from accidental lateral bending. The shoe 14 can be detached from the transportation device 10 so that rider can use it in a manner similar to that of an ordinary shoe before and after riding the transportation device 10. This configuration is more suitable for long distance trips and while using public transportations.

Figure 6:
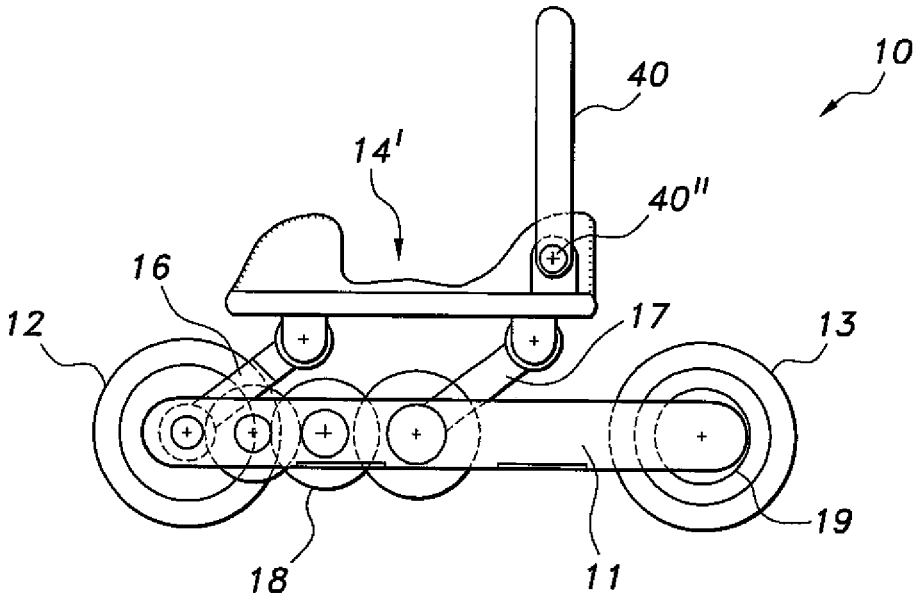
FIG. 6 is a diagrammatic side view of an alternative embodiment of a wheeled personal transportation device powered by the weight of the user according to the present invention.

FIG. 6 illustrates an alternative shoe configuration 14', which allows the user to use his or her ordinary shoes, by providing a secure support frame for the shoe in all directions, using rods, grooves, straps and the like. A support arm 40 is used to protect the foot from accidental lateral bending, while allowing the leg to tilt forward and backward in a natural manner by rotating about axle 40". The gears of the driving mechanism 18 can be engaged with the front wheel 12 to slow it down.

Figure 7:
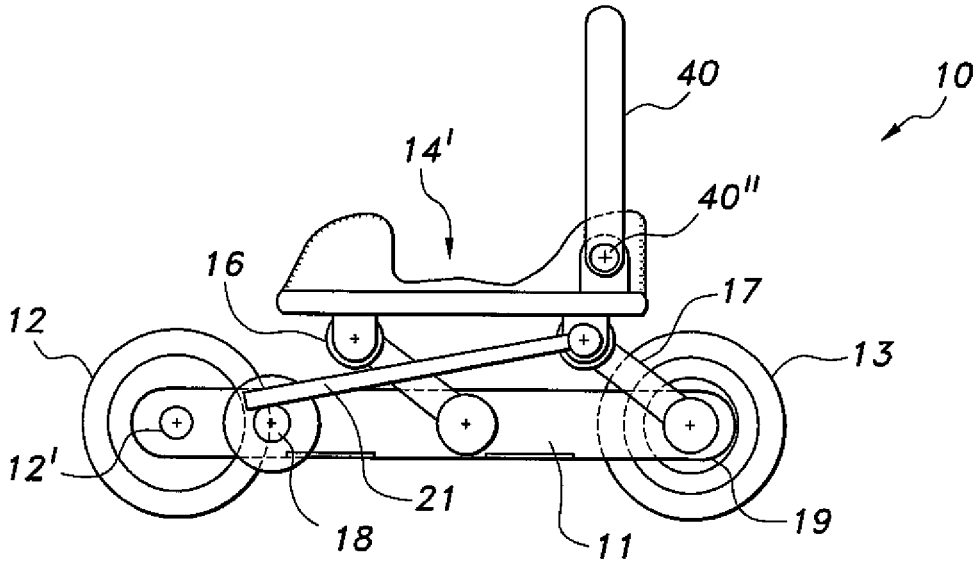
FIG. 7 is a diagrammatic side view of another alternative embodiment of a wheeled personal transportation device powered by the weight of the user according to the present invention.

FIG. 7 shows another configuration for the linkage and driving mechanisms. In this embodiment, the linkage mechanisms 16 and 17 have rotating arms, and a sliding linkage 21 for transferring force to the driving mechanism 18, which is in direct contact with the front wheel 12.

Figure 8:
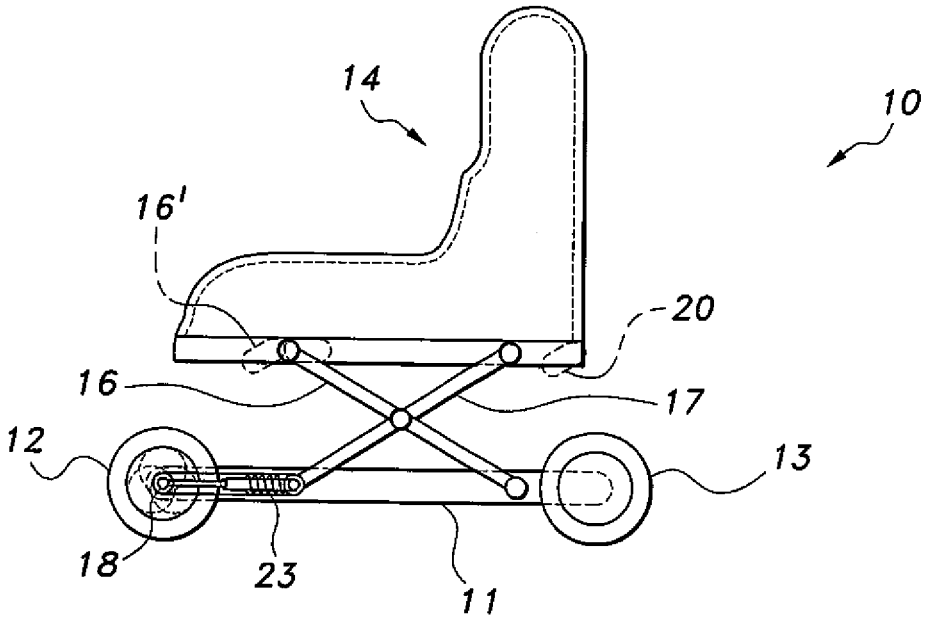
FIG. 8 is a side view of still another alternative embodiment of a wheeled personal transportation device powered by the weight of the user according to the present invention.

FIG. 8 shows another configuration of a personal transportation device, in which linkages 16 and 17 have an X-shape configuration, and the driving mechanism 18 is embedded inside the wheel 12. A spring and sliding link assembly 23 is used to store and transfer the force, which is generated by the weight of the user, to the driving mechanism 18.

Figure 9:
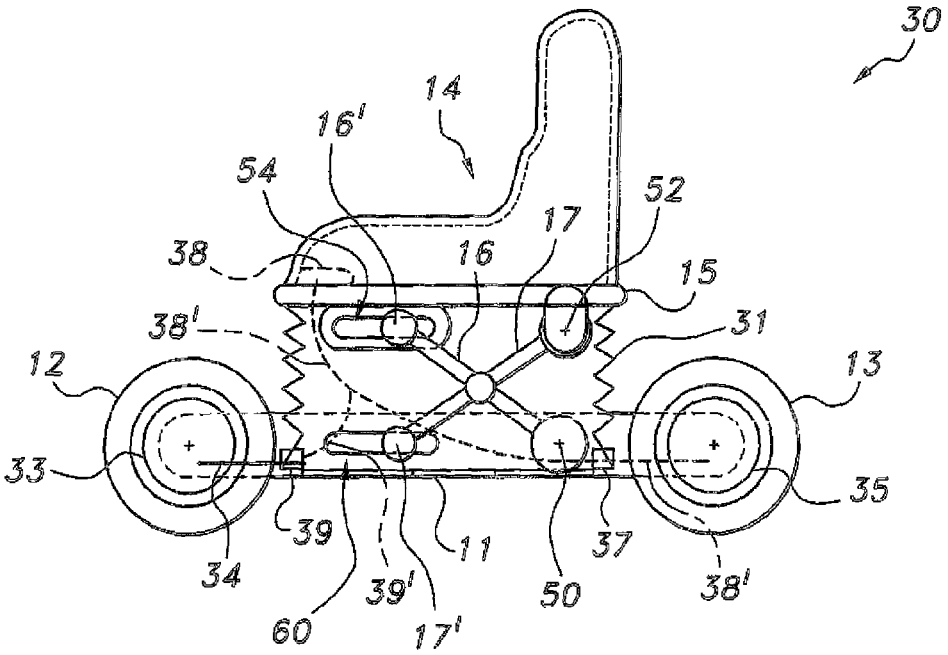
FIG. 9 is a diagrammatic side view of yet another alternative embodiment of a wheeled personal transportation device powered by the weight of the user according to the present invention, which uses a bellows-type air pump and pneumatic motor.

An alternative driving mechanism is shown in FIG. 9, where air is used as a pneumatic fluid to transform the weight of the user into power for driving the personal transportation device 30. A supporting frame 11 is used to support front and back wheels 12 and 13. An air-cushion (or bellows-type air pump) 31 is placed between the foot platform 14 and the supporting frame 11 and may enclose the stability mechanism (i.e., the scissor linkage arms 16, 17). The air-cushion 31 is preferably a sealed, bellows-type enclosure, as shown.

As the user forces the foot platform 14 to go down under his or her own weight, air is compressed inside the air-cushion 31. A tube 34 passes the compressed air to a pneumatic motor 33, which is mounted at and drives the front wheel 12 (the motor shaft may be the front axle), thus moving the transportation device 30 forward until the compressed air is consumed. It should be understood that the pneumatic motor may be either a vane-type air motor or a piston-type air motor Following compression, the user then pulls his or her foot up again, which expands the air cushion 31. A one-way valve 37, mounted within the air-cushion housing, allows ambient air to fill the expanding air-cushion 31 again, thus preparing the device for another cycle. Thus, the air cushion 31 serves as an air pump. The more frequent the user repeats this cycle, the faster the device travels.

It should be understood that braking may be actuated by any conventional braking system. Preferably, as shown in FIG. 9, an actuator 38 is embedded inside the shoe 14 so that the user can use his or her toes to activate a brake 35 placed in the rear wheel 13 through braking wire or tube 38'. It should be understood that any suitable type of wire or tube braking system may be utilized, such as those commonly associated with bicycles. Examples of such brakes are shown in U.S. Pat. Nos. 4,896,753; 5,538,270; and 6,592,129, each of which is hereby incorporated by reference in its entirety. Further, as shown in FIG. 9, a separate line 39', which is in communication with line 38', is joined to a valve 39, which is in communication with the tube 34. Upon actuation of the brake actuator 38, the valve 39 closes, thus ceasing air flow through the tube 34 and cutting fluid power to the motor 33.

As in the previous embodiments, the device 30 includes a foot platform 15, which holds the weight of the user and transfers it to linkage 17. Linkage 16 is used to keep the platform 15 in a parallel position with respect to the transportation attachment 11. The two linkages are interconnected in the middle by a common axle to form an X-shape or scissors configuration. The two linkages 16, 17 are free to rotate about their rear axles 50, 52, respectively, and slide forward while rotating about their front axles 16' and 17', respectively, thus allowing the foot platform 15 to move from the high to the low position. As in the previous embodiments, the front axle 16' is slidable and pivotal within a groove 54 in the platform 15, and the front axle 17' is slidable and rotatable within the groove 60 in the frame of the transportation attachment.

Figure 10:
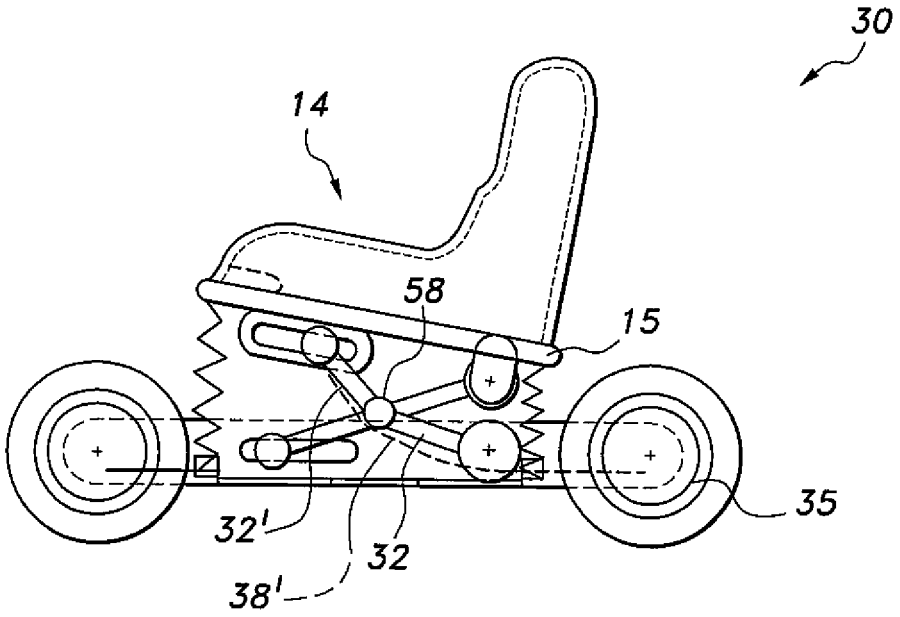
FIG. 10 is a diagrammatic side view of another alternative embodiment of a wheeled personal transportation device powered by the weight of the user according to the present invention, shown in a braking configuration.

Another mechanism allows the foot platform 15 to be tilted backward, as shown in FIG. 10. In this embodiment, linkage 16 is replaced by a pair of linkages 32' and 32, which may pivot with respect to one another about the central pivot 58 of the X-shaped connection. The device 30 of FIG. 10 operates in a manner similar to that of FIG. 9, but with the brake actuator 38 being removed. Instead, a braking line 38' is secured at its front end to linkage 32', and the bending motion of linkage 32' when the user tilts his or her foot back pulls on line 38', thus actuating brake 35.

Figure 11:
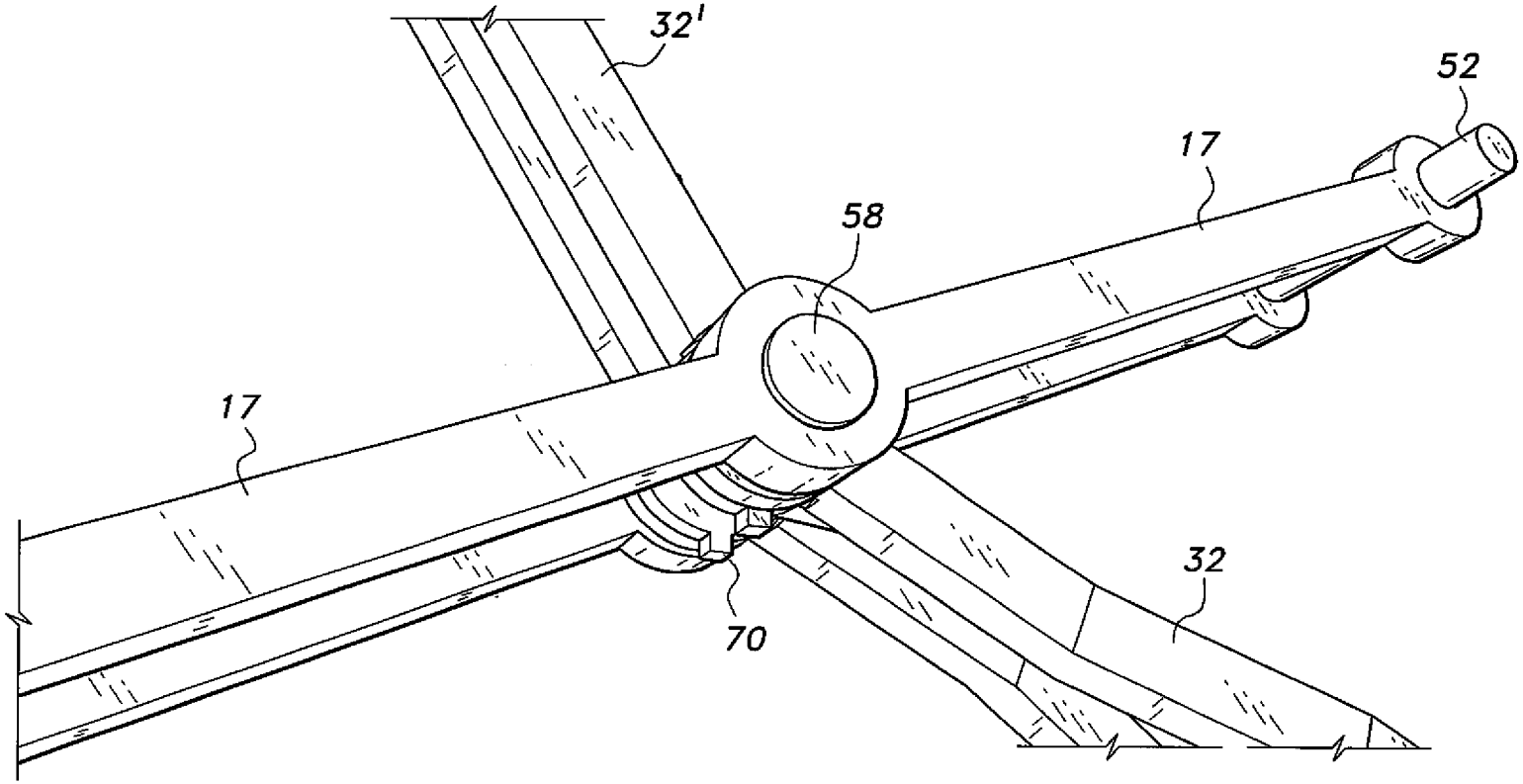
FIG. 11 is a partial perspective view of a linkage of the wheeled personal transportation device of FIG. 10 as viewed from the front.
Figure 12:
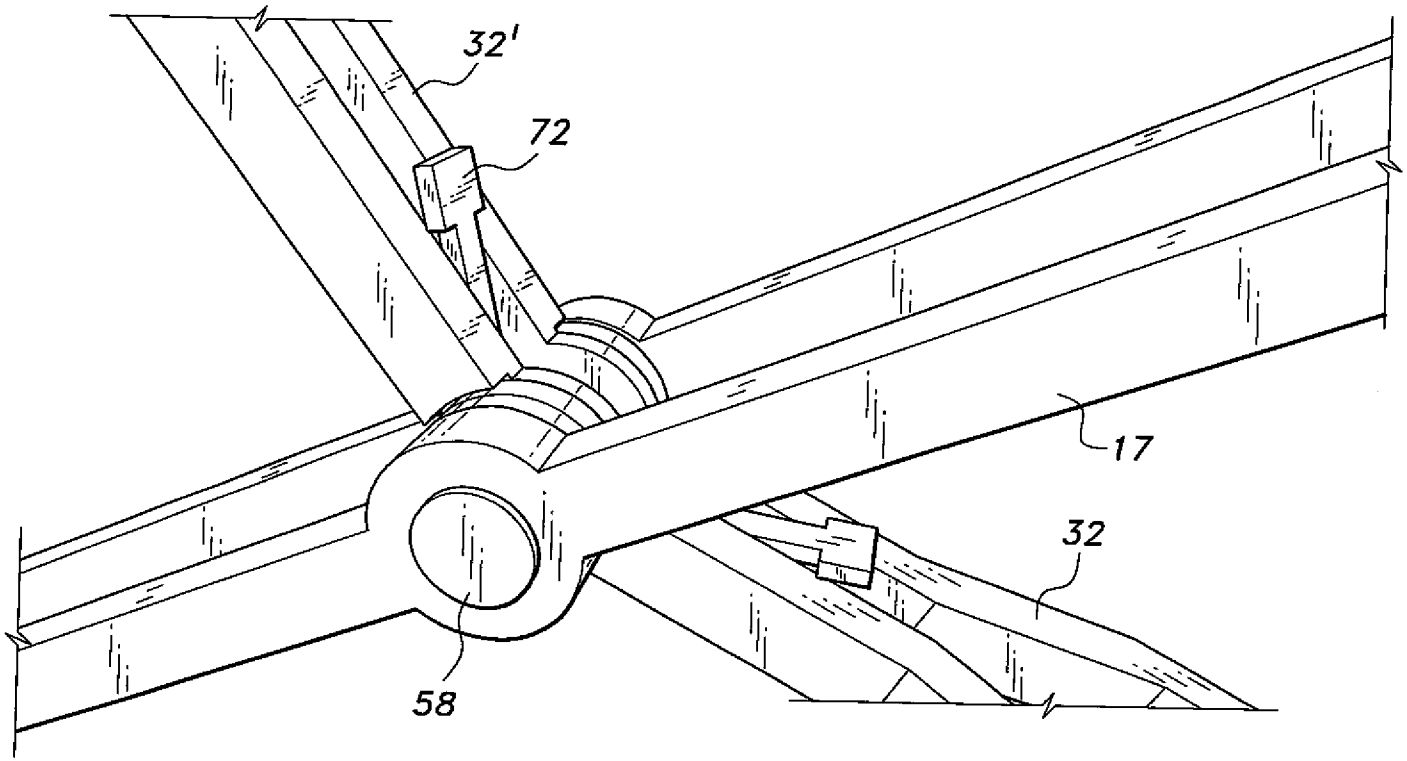
FIG. 12 is a partial perspective view of the linkage of FIG. 11 as seen from the rear.

FIG. 11 shows the interconnection between linkages 32, 32' and linkage 17 about the central pivot 58. In use, the front upper linkage 32' is rotated clockwise (in the orientation of FIG. 11) to actuate braking. This occurs when the user tilts his or her foot backward. One or more pins 70 may be mounted on the lower end of front upper linkage 32' to cease further rotation of the linkage 17 after braking. As shown in FIG. 12, a leaf spring 72 or the like may be used to restore linkage 32' to its original straight position with respect to linkage 32 following braking.

Any suitable material, such as aluminum, composite materials, carbon fibers, hard plastics, polymers, fabrics, steel and metal alloys, etc. may be used to make the different components of the transportation device. Light reflective materials may be added on all sides of the device for safety purposes. Similarly, LED lamps or the like can also be used at night for safety, as well as decorative, purposes. As a further alternative, distance meters or other performance measures may also be added.

In order to maintain forward movement, the rider simply raises and lowers his or her right and left feet in an alternating pattern, as if moving up a set of stairs.

It is to be understood that the present invention is not limited to the embodiments described above, but encompasses any and all embodiments within the scope of the following claims.

I claim:

1. A wheeled personal transportation device, comprising:

a frame member having a front end and a rear end, the frame member having a first pivot axle rigidly attached to the rear end thereof;

a plurality of ground-engaging wheels attached to the frame member, including a front wheel mounted at the front end of the frame member, a rear wheel mounted at the rear end of the frame member, and at least one intermediate wheel mounted between the front end and the rear end;

a foot platform disposed above the frame member, the foot platform being adapted for supporting a user's foot, the foot platform having a front end and a rear end, the foot platform having a second pivot axle fixed to the rear end thereof;

a scissors linkage connecting the frame member and the foot platform, the scissors linkage having:

a first pair of parallel scissors arms having a first end and a second end, the first end being pivotally mounted on the first pivot axle and the second end being slidably and pivotally attached to the front end of the foot platform;

a second pair of parallel scissors arms having a first end and a second end, the first end being pivotally mounted on the second pivot axle and the second end being slidably and pivotally attached to the front end of the frame member; and a pivot pin extending through a central portion of the first pair of scissors arms and the second pair of scissors arms between the first and second ends of the scissors arms, the scissors linkage being pivotal between a lowered position and a raised position when the foot platform is raised and lowered by the user; and means for converting energy expended when lowering the foot platform into powered rotation of the front wheel;

wherein the means for converting energy including a flexible air cushion extending between the foot platform and the frame;

a pneumatic motor mounted on the frame, the pneumatic motor having a shaft, the front wheel being mounted on the pneumatic motor shaft; and a tube extending from the air cushion to the pneumatic motor;

wherein the air cushion is inflated when the foot platform is raised above the frame, the air being compressed when the foot platform is lowered to the frame, the compressed air being transmitted to the pneumatic motor through the tube to rotate the pneumatic motor shaft and the front wheel.

2. The wheeled personal transportation device according to claim 1, further comprising a boot permanently mounted on the foot platform.

3. The wheeled personal transportation device according to claim 1, further comprising means for releasably attaching a user's shoe to the foot platform.

4. A wheeled personal transportation device, comprising:

a frame member having opposed front and rear ends;

a front wheel rotatably mounted to the front end of the frame member;

a rear wheel rotatably mounted to the rear end of the frame member;

an air cushion having upper and lower ends, the lower end being supported by the frame member;

a foot platform mounted on the upper end of the air cushion, the foot platform being adapted for supporting a foot of a user;

a pneumatic motor mounted on the front end of the frame member and being in communication with the front wheel for selectively driving rotation thereof, the pneumatic motor being in fluid communication with the air cushion such that compression of the air cushion drives the pneumatic motor to drive rotation in the front wheel; and a pneumatic brake in communication with the rear wheel for selective braking thereof.

5. The wheeled personal transportation device as recited in claim 4, further comprising a shoe for receiving the foot of the user, the shoe being mounted on the foot platform.

6. The wheeled personal transportation device as recited in claim 4, further comprising:

a brake actuator mounted in the shoe for selective actuation by the foot of the user; and a brake line extending from the brake actuator to the pneumatic brake for actuation thereof.

7. The wheeled personal transportation device as recited in claim 6, further comprising a tube in fluid communication with the air cushion and the pneumatic motor for fluid transfer therebetween.

8. The wheeled personal transportation device as recited in claim 7, further comprising:

a one-way valve mounted in the tube; and a secondary brake line extending from the brake line to the one-way valve, such that the one-way valve seals the tube when the brake actuator is actuated by the user.

9. The wheeled personal transportation device as recited in claim 4, further comprising first and second linkages centrally pivotally secured to one another about a central pivot in an X-type configuration, an upper end of the first linkage being slidably mounted to a front end of the foot platform, a lower end of the first linkage being pivotally secured to a rear end of the frame member, an upper end of the second linkage being pivotally secured to the rear end of the foot platform, and a lower end of the second linkage being slidably mounted to the front end of the foot platform.

10. The wheeled personal transportation device as recited in claim 9, wherein the first linkage comprises an upper portion and a lower portion, the upper portion being pivotally secured to the lower portion about the central pivot.

11. The wheeled personal transportation device as recited in claim 10, further comprising a brake line extending from the upper portion of the first linkage to the pneumatic brake for actuation thereof when the foot platform is pivoted such that the rear end of the foot platform is lowered and the front end of the foot platform is raised.

12. The wheeled personal transportation device as recited in claim 10, further comprising at least one pin secured to a lower end of the upper portion of the first linkage, adjacent the central pivot, to limit rotation thereof with respect to the lower portion of the first linkage.

13. The wheeled personal transportation device as recited in claim 12, wherein the upper and lower portions of the first linkage are spring-biased with respect to one another.

* * * * *